United States Patent [19]

Landa et al.

[11] Patent Number: 4,538,899

[45] Date of Patent: Sep. 3, 1985

[54] CATALYTIC FIXER-DRYER FOR LIQUID DEVELOPED ELECTROPHOTOCOPIERS

[75] Inventors: Benzion Landa, Edmunton, Canada; Oded Sagiv, Ramat-Gan, Israel

[73] Assignee: Savin Corporation, Stamford, Conn.

[21] Appl. No.: 468,507

[22] Filed: Feb. 22, 1983

[51] Int. Cl.[3] ..... G03G 15/00; G03G 15/12

[52] U.S. Cl. ..... 355/10; 355/3 SH; 355/3 FU; 422/4; 422/173; 422/199; 34/155

[58] Field of Search ..... 355/10, 14 SH, 35 H, 355/3 R, 16, 3 FU; 422/4, 122, 173, 174, 199; 118/262, 642, 661; 430/32; 34/155, 156, 157, 158

[56] References Cited

U.S. PATENT DOCUMENTS

| | | | |
|---|---|---|---|
| 3,854,224 | 12/1974 | Yamaji et al. | 355/10 X |
| 3,880,515 | 4/1975 | Tanaka et al. | 355/10 |
| 3,907,423 | 9/1975 | Hayashi et al. | 355/10 |
| 3,957,369 | 5/1976 | Wirth | 355/10 |
| 4,415,533 | 11/1983 | Kurotori et al. | 355/10 X |
| 4,462,675 | 7/1984 | Morow et al. | 355/10 X |

*Primary Examiner*—A. C. Prescott

*Attorney, Agent, or Firm*—Shenier & O'Connor

[57] ABSTRACT

A liquid developed electrophotocopier wherein liquid carrier dispersant transferred to a copy sheet concomitantly with the developed image is catalytically oxidized to provide harmless gaseous oxidation products at temperatures sufficiently elevated to vaporize transferred carrier and to dry and fix the transferred image. The catalytic fixer-dryer is brought rapidly to operating temperature by injecting an atomized spray of carrier liquid. The carrier liquid has a low auto-oxidation temperature; and the fixer-dryer is operated above such temperature to ensure complete oxidation of carrier vapors even though the catalyst may have been largely rendered inactive.

67 Claims, 5 Drawing Figures

BLOWER
14
14a
RELAY
232
R F
S F
230
228
224
200
198
196
.8 SEC.
222
220
226
M
INJECTION PUMP SOLENOID
18a
216
S F
R F
214
3 SEC.
212
210
RELAY
PREHEATERS
58
208
206
204
450°
202
178
218
176
174
560°
172
168
°F.
57
70°
170
τ = .2 SEC.
τ = .4 SEC.
194
192
190
188
186
÷ 45
180
182
39° TO 50°
37.5°
184
81
260
S F
R F
.1 SEC.
236
234
250
256
238
.1 SEC.
248
246
252
NUMBER OF COPIES
COMPLETED
254
15 SEC.
240
R
242
R S
F F
244
PRINT
ON
160
158
DRIVE
10
DEVELOPER
136
CARRIER
142
COOLING
12
POWER SUPPLY
166
S R
F F
162
RELAY
164
TO 210
TO 232
156

CATALYTIC FIXER-DRYER FOR LIQUID DEVELOPED ELECTROPHOTOCOPIERS

BACKGROUND OF THE INVENTION

In liquid developed electrophotocopiers, the developer comprises toner particles suspended in a dielectric carrier or dispersant liquid. Latent images formed on a photoconductive surface are developed by contact with the liquid developer. The charged toner particles are attracted to the latent image; and the entire photoconductive surface is wetted by the carrier or dispersant. The developed image on the photoconductive surface is usually subjected to the action of a closely spaced reverse roller which reduces to a minimum the thickness of the layer of carrier liquid on the drum surface. When a copy sheet is brought into contact with the drum surface and the image transferred to the copy sheet, the entire copy sheet is slightly wetted or dampened by the dispersant carrier liquid. The copy sheet is then heated, not only to vaporize the carrier liquid in non-image areas, but also to fix the developed image. In image areas, a small portion of the dispersant carrier may combine with the toner particles; and the residual uncombined carrier must be vaporized.

The drying and fixing of liquid developed electrophotocopier images is usually accomplished by electrical heaters. Normal 120 volt, 15 ampere, electrical service provides an available power of 1800 watts. This amount of power is suitable only for liquid developed electrophotocopiers providing perhaps ten to twenty copies per minute. For electrophotocopiers providing more than thirty copies per minute, a 220 volt high amperage electrical service must be available. Electrophotocopiers employing electrical heaters for drying and fixing typically require at least thirty seconds for the heaters to be brought up to operating temperature. While copies can be produced in a shorter time, such as twenty seconds, the heaters are at too low a temperature; and the initial copy will be faint and poorly fixed.

The vaporized carrier or dispersant, while posing no inherent toxicological hazard, is at least a nuisance; and the room or space in which the electrophotocopier is operated must be adequately ventilated to limit the concentration of dispersant vapor in the air to a reasonably low level. For high speed electrophotocopiers providing more than thirty copies per minute, a hooded exhaust system may have to be installed.

It has been proposed to recycle the carrier vapors and return them in liquid form to the developer supply container of the electrophotocopier. One method of recycling the vaporized carrier is by condensation, which requires bulky and heavy refrigeration equipment providing a sufficiently low temperature to condense an appreciable portion of the vaporized dispersant. Another method is to pass the vapors through an activated charcoal filter for subsequent collection in liquid form.

SUMMARY OF THE INVENTION

In general our invention contemplates the provision of a liquid developed electrophotocopier in which the carrier or dispersant liquid for the developer suspension is not only dielectric but also is a hydrocarbon. The carrier vapor driven from a copy sheet is catalytically oxidized to carbon dioxide and water vapor at relatively low temperatures so that no hazardous open flames are present and no oxides of nitrogen can result. The products of oxidation are the same as the exhalations of human beings; and there is no toxicological hazard. If the hydrocarbon dispersant contains minute or trace amounts of normal hexane or benzene, both of which are toxic, the catalytic oxidation of the carrier vapors ensures that any trace amounts of these two toxic substances will also be converted into harmless carbon dioxide and water vapor. The heat released during this catalytic oxidation is used to dry and fix the image transferred to a copy sheet; and our electrophotocopier can provide in excess of sixty copies per minute with minimal electrical power.

We overcome the problem of a lengthy warmup time by spray injection of small amounts of the liquid hydrocarbon carrier or dispersant, which rapidly brings the gaseous oxidation products to the desired operating temperature. Typically, the warm-up time for our electrophotocopier is less than eight seconds.

One object of our invention is to provide a liquid developed electrophotocopier wherein the carrier liquid is a dielectric hydrocarbon and wherein vaporized carrier liquid driven from a copy sheet during drying and fixing of the transferred image is catalytically oxidized into harmless oxidation products.

Another object of our invention is to provide a liquid developed electrophotocopier wherein the heat provided by such catalytic oxidation of carrier liquid on a copy sheet is utilized to dry the copy sheet and fix the transferred image.

Still another object of our invention is to provide a liquid developed electrophotocopier wherein the hot gaseous products resulting from catalytic oxidation of carrier liquid on a copy sheet are directed against the copy sheet to dry and fix the transferred image.

A further object of our invention is to provide a liquid developed electrophotocopier of extremely high speed which requires minimal electrical energy.

A still further object of our invention is to provide a liquid developed electrophotocopier which is rapidly brought up to operating temperature by catalytic oxidation of small amounts of the liquid hydrocarbon carrier sprayed from an injection pump.

Still a further object of our invention is to provide a catalytic dryer and fixer for liquid developed electrophotocopiers which is of relatively small size.

Other and further objects of our invention will appear from the description of the preferred embodiment.

THE PRIOR ART

Brown et al U.S. Pat. No. 3,767,300 and Katayama et al U.S. Pat. No. 3,890,721 and Tanaka et al U.S. Pat. No. 3,880,515 show liquid developed electrophotocopiers wherein carrier vapor driven off from the copy sheet during drying and fixing is recovered by employing refrigeration equipment to condense the vapors.

Smith et al U.S. Pat. No. 3,741,643 describes the absorption of carrier vapors of liquid developed electrophotocopiers by activated charcoal filters.

Offenlegungsschrift No. 1,966,591 describes a liquid developed electrophotocopier wherein the carrier vapor is either removed in a trap of absorbent pads or by condensing of the carrier vapors.

Stern U.S. Pat. No. 4,176,162 and the article by Bialous on pages 66 through 70 of the November, 1978 issue of "Paper, Film and Foil Converter" both describe the Bobst-Champlain Inc. system for oxidizing the solvents, such as toluene, of the solvent-based inks used in rotogravure printing presses which consume from ten to thirty gallons per hour of the solvent-based inks. These references disclose the preheating of solvent-laden vapor in a first pebble bed heat exchanger, the introduction of the preheated vapors into an oxidation chamber having a burner providing open flames from any energy source such as gas or oil, and the subsequent passage of the products from the oxidation chamber through a second pebble bed heat exchanger which cools the exhaust gases. The first and second pebble bed heat exchangers are alternately reversed. As indicated by Bialous, the gas or oil burner used in the oxidation chamber typically provides up to two million BTU per hour. The amount of solvent to be oxidized is not a substantial constant but instead varies over wide limits depending upon the density of printing of the solvent-based inks. Stern indicates that while a catalytic afterburner has also been developed, the catalytic beds are expensive and require high maintenance.

Villalobos U.S. Pat. No. 3,905,126 shows a system similar to Stern for color printing presses wherein the various ink solvents, such as toluol, are oxidized in an incinerator provided with high output burner assemblies; and heat from the incinerator is recovered through a recirculating oil heat exchanger to preheat the air and vapors passing into the incinerator.

Betz U.S. Pat. No. 3,486,841 shows a system for catalytically oxidizing solvents evolved in drying protective lacquer coatings employing a recirculating liquid heat exchanger.

Ruff U.S. Pat. No. 2,921,778 and Weber U.S. Pat. No. 3,561,928 both show systems for catalytically oxidizing solvent vapors evolved in the enamel coating of wires.

Adey et al U.S. Pat. No. 3,085,348 shows a laundry dryer wherein lint from clothes is catalytically combusted.

BRIEF DESCRIPTION OF THE DRAWINGS

In the accompanying drawings which form part of the instant specification and which are to be read in conjunction therewith and in which like reference numerals are used to indicate like parts in the various views.

DESCRIPTION OF THE PREFERRED EMBODIMENT

Figure 1:
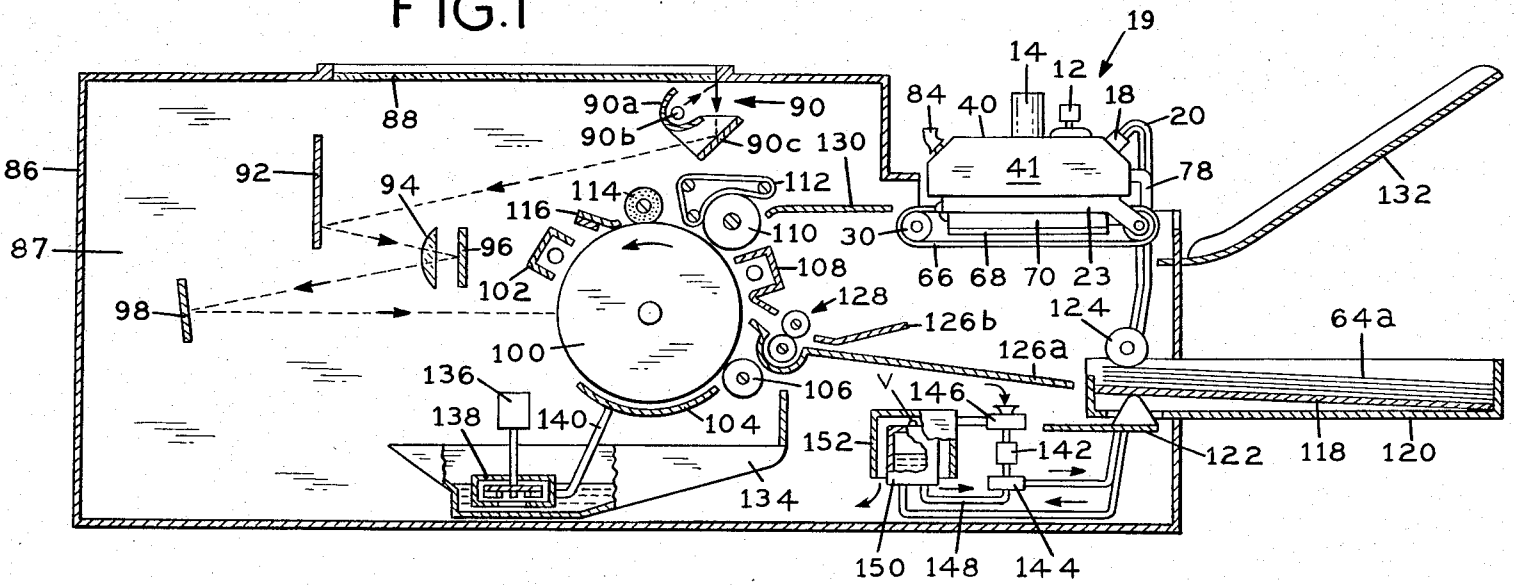
FIG. 1 is a front sectional view of a liquid developed electrophotocopier employing our catalytic dryer and fixer.

Referring now to FIG. 1 of the drawings, the electrophotocopier includes a cabinet 86 having a backwall 87 and a top wall in which is mounted a transparent platen 88 upon which is placed the original to be copied. A full-rate scanning carriage indicated generally by the reference numeral 90 is provided with an illuminating lamp **90*b* mounted at one focus of a semi-elliptical reflector 90*a* which directs light through the transparent platen 88 to illuminate the original to be copied. Light reflected from the original passes downwardly and strikes a scanning mirror 90*c* also mounted on full-rate carriage 90. Upon a half-rate scanning carriage (not shown) is mounted a half-rate scanning mirror 92. Light from the full-rate mirror 90*c* is reflected from the half-rate mirror 92 and is directed to a focusing device comprising lens 94 in conjunction with mirror 96. Light from half-rate scanning mirror 92 passes through lens 94, is then reflected from mirror 96, and again passes through lens 94. Light from the focusing device is reflected from a stationary mirror 98 and brought to a focus upon the photoconductive surface of a drum 100**, which rotates counterclockwise, as shown by the arrow.

The photoconductive surface of drum 100 is charged by a corona 102 and then exposed to light from the original document to be copied. The latent image is then developed by an electrically biased development electrode 104 somewhat spaced from the bottom of drum 100. Into this space is pumped a liquid developer through a pipe 140 from a centrifugal pump 138 driven by a motor 136. Pump 138 is positioned within a developer tank 134 and takes suction adjacent the bottom thereof. The photoconductive surface of drum 100 is thus immersed in the liquid developer; and the dispersant or carrier wets the entire surface of the drum. To reduce the thickness of this carrier liquid layer to a minimum, a reverse roller 106 is provided having a small spacing from the drum surface and which rotates counterclockwise to shear liquid from the surface of the drum.

A stack of copy paper **64*a* is positioned upon a shelf 118, carried by a tray 120 which is mounted on the right side of the machine. The shelf 118 is lifted by a spring finger 122 until stack 64*a* engages a feed wheel 124. A sheet of copy paper delivered by feed wheel 124 is guided by co-acting members 126*a* and 126*b* into the nip of a pair of registration rollers 128. At a proper point in the cycle, registration rollers 128 advance a copy sheet 64 onto the surface of drum 100. A transfer corona 108 applies to the back surface of the copy sheet a charge which assists transfer of the developed image from the surface of drum 100 to the front surface of the copy sheet. Copy sheet passes under a turn roller 110 engaged by a belt 112; and pickoff means (not shown) lift the leading edge of the copy sheet from the drum and direct it between roller 110 and belt 112. Copy sheet 64 is then guided by member 130 into our catalytic dryer and fixer unit indicated generally by the reference numeral 19. Unit 19 includes a belt 66 mounted on rollers 30 and 28 which carries a copy sheet through unit 19 and deposits the dried and fixed copy sheet upon an output tray 132**.

Figure 3:
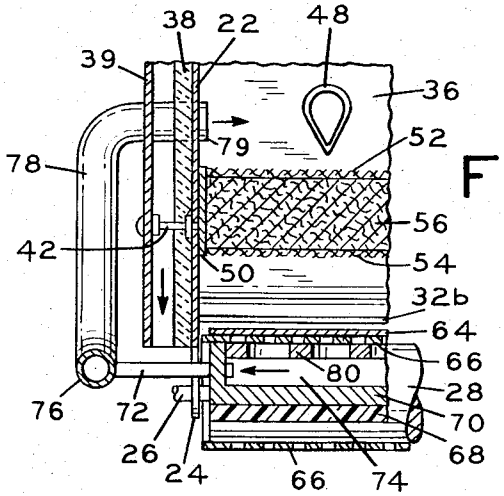
FIG. 3 is a fragmentary left side sectional view taken along the lines 3—3 in FIG. 2.
Figure 2:
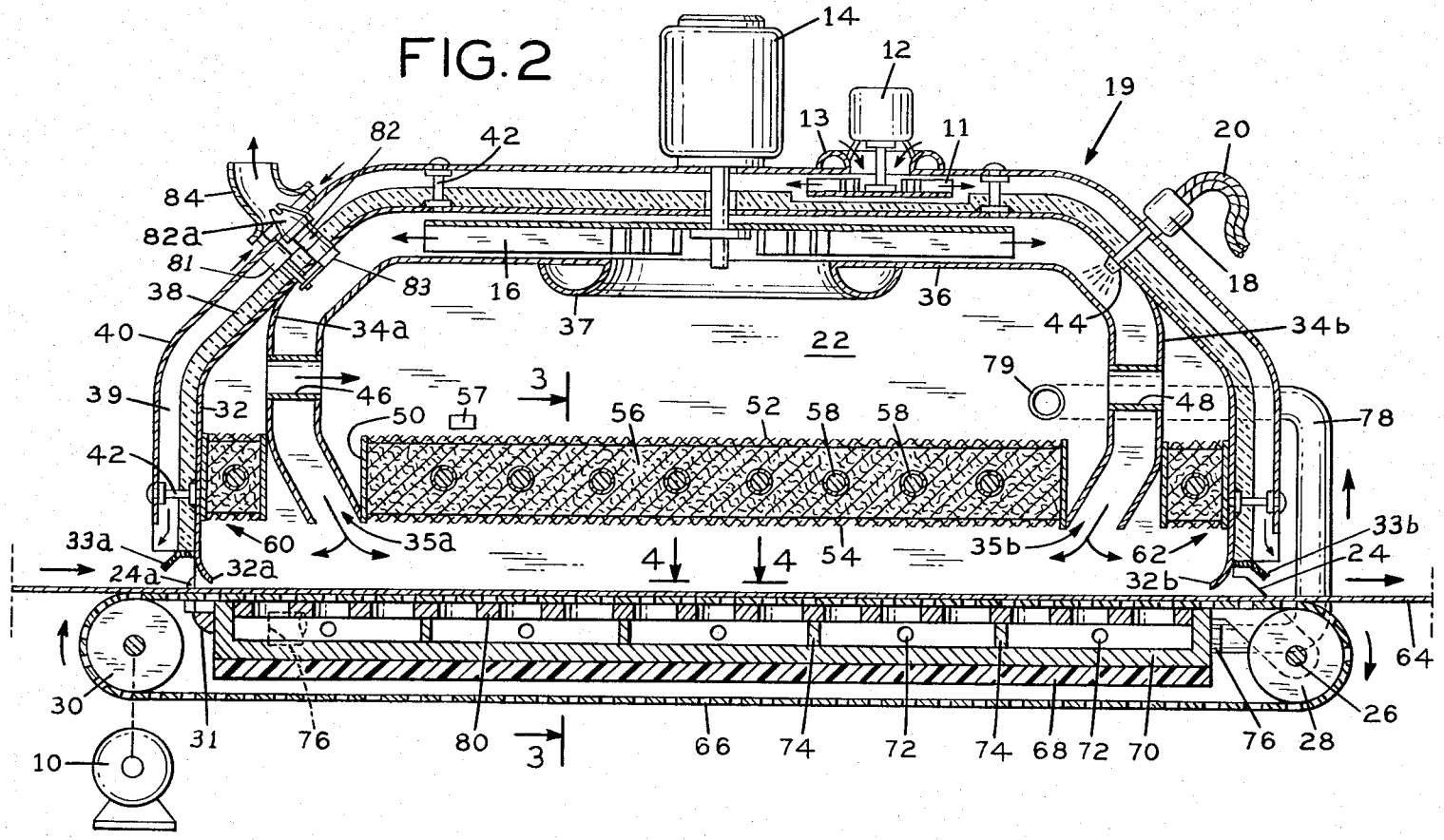
FIG. 2 is a front sectional view on an enlarged scale showing the details of construction of our catalytic dryer and fixer.

Referring now to FIG. 2 of the drawings, the dryer-fixer unit 19 includes a main shell 32 provided with a rear wall 22 and a front wall 23 (FIG. 1). The main shell 32 is provided with a downwardly extending and inwardly curved leading edge lip **32*a* and a similar downwardly extending and inwardly curved trailing edge lip 32*b*. Lips 32*a* and 32*b* extend fairly close to the surface of copy sheet 64; and fresh air enters unit 19 through the gaps therebetween. The main shell rear wall 22 is provided with an extension 24 which is journalled upon a shaft 26 which mounts roller 28. The front wall 23 of the main shell is provided with a similar extension which is journalled on the near end of shaft 26, as may be seen by reference to FIG. 1. Shell 32 and the front and rear walls 23 and 22 are covered with a layer of heat insulation 38. Walls 22 and 23 extend downwardly appreciably beyond belt 66 to confine the gases and vapors circulating within unit 19. As shown in FIG. 3, only a small clearance gap exists between belt 66 and sidewalls 22 and 23** to reduce gas leakage.

The lower left edges of sidewalls 22 and 23 (FIGS. 1 and 2) rest upon a quarter-round member 31 and are provided with outwardly flared extensions 24*a* to guide a copy sheet between the sidewalls. Unit 19 may be rotated clockwise about shaft 26 to expose belt 66 and perhaps remove any copy paper in the remote event it becomes jammed within unit 19.

An outer shell 40 is secured to the main shell 32 by a plurality of stantions 42 in spaced relationship to the insulating layer 38. The outer shell includes a front wall 41 (FIG. 1) and a rear wall 39 (FIGS. 2 and 3). The outer shell 40 is provided with a cooling air inlet 13. Disposed on a spider in inlet 13 is a motor 12 which drives a centrifugal blower 11 mounted in the space between shell 40 and insulating layer 38. Cooling air flows through inlet 13 and thence through impeller 11 and is discharged downwardly adjacent lips 32*a* and 32*b* and also adjacent the bottoms of sidewalls 39 and 41.

Main shell 32 is provided with members 34*a* and 34*b* which extend between sidewalls 22 and 23. An inner shell 36 also extends between sidewalls 22 and 23. The inner shell 36 is provided with a gas inlet 37. Mounted between inner shell 36 and main shell 32 is the impeller 16 of a centrifugal blower driven by a motor 14 mounted on outer shell 40. Gases flow through inlet 37 to the eye of impeller 16 and are discharged in the space between inner shell 36 and members 34*a* and 34*b*.

The lower portion of member 34*a* in conjunction with a lower portion of inner shell 36 defines an outlet nozzle 35*a*, the axis of which is directed downwardly and to the right at an angle of perhaps 30° from a normal to paper 64. Similarly, the lower portion of member 34*b* in conjunction with a lower portion of inner shell 36 define an outlet nozzle 35*b*, the axis of which is directed downwardly and to the left at an angle of perhaps 30° from a normal to paper 64. Nozzles 35*a* and 35*b* extend across the full width of the paper between the sidewalls 22 and 23.

A plurality of two or more equally spaced short pipes 46 extend from member 34*a* to the inner shell 36. A corresponding plurality of equally spaced short pipes 48 extend between member 34*b* and inner shell 36. Pipes 46 and 48 pierce nozzles 35*a* and 35*b*. To reduce flow losses in nozzles 35*a* and 35*b*, pipes 46 and 48 may have an airfoil cross-section with a rounded upper portion or leading edge and a pointed lower portion or trailing edge, as may be seen in FIG. 3.

The main catalyst bed is provided with a frame 50 which is secured to the lower ends of the inner shell 36 adjacent the outlets of nozzle 35*a* and 35*b*. Frame 50 extends between sidewalls 22 and 23 as may be seen in FIG. 3. The catalyst bed 56 comprises silica wool fibers having a diameter of 8 microns or 0.32 mil coated with an extremely thin layer of platinum. We have found that Catalytic Pad No. 1877901 manufactured by Englehart Corporation is satisfactory. The catalyst pad 56 is held in place by respective upper and lower layers 52 and 54 of a tightly woven fabric formed of glass fibers stretched on frame 50.

A plurality of spaced preheater wires 58 are inserted through the compliant pad 56; and these wires extend substantially between sidewalls 22 and 23. The heater wires 58 may have a diameter of approximately 7 mils and may be formed of Nichrome V, a registered trademark of Driver-Harris Company, for a resistance heating element comprising 80% nickel and 20% chrome. Nichrome has an appreciable temperature coefficient of linear expansion, and requires spring-loaded mounting adjacent one of walls 22 and 23 to maintain the wires reasonably taut at elevated temperatures.

An auxiliary catalyst bed indicated generally by the reference numeral 60 is provided between main shell 32 and member 34*a*. Another auxiliary catalyst bed indicated generally by the reference numeral 62 is provided between main shell 32 and member 34*b*. The auxiliary catalyst beds 60 and 62 have a construction similar to that of the main catalyst bed, but are much smaller and may be provided with only one preheater wire 58.

Belt 66 rides on rollers 30 and 28; and as previously indicated shaft 26 of roller 28 also mounts the extensions 24 of sidewalls 22 and 23 which permits pivoting of unit 19 about shaft 26. Belt 66 passes over an apertured plate 80 which is mounted within a vacuum bed 70. The bottom of vacuum bed 70 may be provided with a heat insulating layer 68. Vacuum bed 70 is provided with a plurality of partitions 4 which divide the bed into a corresponding number of perhaps five compartments, as shown. Rearwardly extending pipes 72 of relatively small diameter provide communication between each of the vacuum bed compartments and a vacuum manifold 76. Manifold 76 communicates with a flexible vacuum manifold 78 which may be formed of a spirally wrapped and interlocked continuous strip of metal. Manifold 78 extends through the rear wall 39 of the outer shell, through heat insulating layer 38 and through the rear wall 22 of the main shell to an outlet 79 disposed above the main catalyst bed which communicates with the suction inlet 37 of impeller 16.

A solenoid actuated liquid carrier injection pump 18 is mounted on the outer shell 40. Pump 18 discharges through a spray nozzle 44 disposed between shells 32 and 36 adjacent the periphery of impeller 16.

Shell 32 also mounts the body 82 of one or more variable exhaust nozzles. As is well known to the art, the body 82 is provided with a tapered pin which coacts with a tapered nozzle 82*a* provided with internal threads which coact with external threads on stationary body 82. Nozzle 82*a* may be provided with a slot for insertion of a flat-bladed screw driver. Rotation of nozzle 82*a* clockwise from above, for example, screws nozzle 82*a* downwardly upon member 82 thus reducing the annular exhaust area between the tapered pin and nozzle 82*a*. Nozzle 82*a* extends through a clearance hole in outer shell 40 into an exhaust ejector 84 mounted in spaced relationship to the outer shell 40. The high velocity, high temperature exhaust gases issuing from nozzle 82*a* induce a flow of cool air into the base of ejector 84 adjacent shell 40. The outlet of ejector 84 is thus a gas stream of reduced temperature and velocity.

The main drive motor 10 for the electrophotocopier may also drive, for example, roller 30.

Referring again to FIG. 1, a small container 150 is provided with an auxiliary supply of the carrier or dispersant. Container 150 is provided with a one-way valve V which permits entry of air into the container but prevents carrier or dispersant vapors from being lost. Conduit 148 extends from container 150 to the inlet of a centrifugal pump 144 driven by a motor 142. Dispersant from pump 144 is continuously supplied through one of flexible conduits 20 to injection pump 18; and a major portion is continuously returned through the other of flexible conduits 20 to container 150. Motor 142 also drives a small centrifugal air blower 146 which supplies cooling air to a shroud 152 surrounding container 150 to carry off any heat transferred to the dispersant from injector 18 or the adjacent portions of conduits 20.

Figure 4:
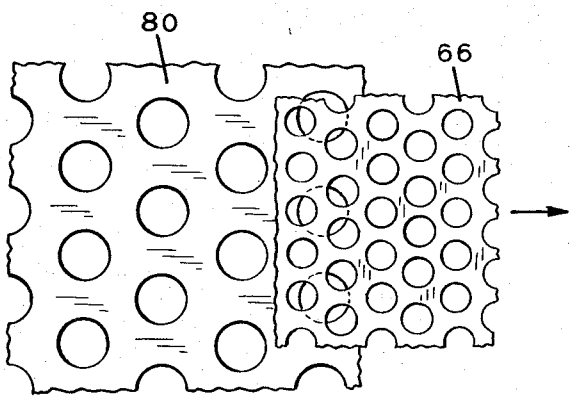
FIG. 4 is a fragmentary top view taken along the lines 4—4 in FIG. 2.

Referring now to FIG. 4, the apertured vacuum plate 80 may be provided with relatively large and widely spaced circular apertures; while belt 66 may be provided with relatively smaller circular apertures having a relatively smaller spacing. Since any given portion of belt 66 is successively moved into and out of unit 19, it adversely acts as a matrix heat exchanger. To reduce loss of heat, belt 66 should have a small mass and accordingly may be formed of a metal such as stainless steel having a thickness in the range from 1.5 to 5 mils, for example. Belt 66 is subject to wear against plate 80; and its life would be impaired if unduly thin.

In operation, unit 19 is brought up to operating temperature by first energizing the preheaters 58 to bring portions of the catalyst bed 56 up to an enabling temperature. Then carrier liquid is injected by pump 18 until the entire volume of gases within unit 19 is at the desired temperature. Impeller 16 recirculates the gases and vapors within unit 19 from the outlet of impeller 16 through nozzles 35*a* and 35*b*, thence largely through the main catalyst bed back to the inlet of impeller 16. The angling of nozzles 35*a* and 35*b* toward one another creates under the main catalyst bed a slightly higher pressure than that existing under the auxiliary beds 60 and 62. Some hot gases pass through the auxiliary beds 60 and 62 and thence through pipes 46 and 48 to the inlet 37 of impeller 16. The gap or spacing between the lower fabric layer 54 of the catalyst beds and the paper 64 may be approximately half an inch.

The oxidation of carrier vapors requires a small but continual supply of fresh air into unit 19 of a volume equal to that exhausted through nozzle or nozzles 82*a*. Lips 32*a* and 32*b* assist in preventing loss of hot gases within unit 19. Fresh air flows into unit 19 under lips 32*a* and 32*b*. The spacing of these lips from paper 64 should be sufficiently small that the velocity of fresh air flow is greater than the speed of paper 64. The cooling air flowing through impeller 11 is warmed and exhausted adjacent lips 32*a* and 32*b*. The fresh air flowing under lips 32*a* and 32*b* is thus warmed; and some of the heat loss in the cooling air is recovered. Mounted on the main shell 32 immediately above lips 32*a* and 32*b* are a pair of vanes 33*a* and 33*b* which extend at least partially into the cooling air exhaust path and deflect cooling air somewhat away from lips 32*a* and 32*b*. The vacuum system including bed 70, apertured plate 80 and belt 66 ensures that the copy sheet 64 is maintained in contact with belt 66 and not lifted therefrom by the relatively high velocity streams issuing from nozzles 35*a* and 35*b*.

The vacuum pressure available to hold the copy sheet on belt 66 is essentially a function of the pressure loss through the catalyst beds. This pressure loss may be made moderately high by providing the fabric layers 52 and 54 with a relatively close weave. The catalyst beds may have a height of from one-half inch to one inch, and provide a further pressure drop depending upon the degree of compaction of the fibers.

When no copy paper is present, hot gases within unit 19 are drawn through the apertures in belt 66 and the plate 80 into the various compartments of the vacuum bed 70. Pipes 72 are of sufficiently small diameter to limit or restrict the flow. When paper 64 enters unit 19, the compartments of vacuum bed 70 are successively covered. The small size of each of pipes 72 prevents the loss of vacuum in any uncovered compartment from destroying that in any covered compartment.

The hot gases within unit 19 directly playing upon the surface of the copy sheet evaporate carrier from non-image areas and evaporate from image areas all carrier except that which is fixed to the image. The hot gases issuing from nozzles 35*a* and 35*b* are of course cooled not only in heating the paper but also in evaporating the dispersant. The mixture of cooled gases and carrier vapors then enters all three catalyst beds, where the vapors are oxidized and the gases restored to their initial high temperature.

The carrier or dispersant for the liquid developer of the electrophotocopier is preferably Isopar G, a registered trademark of the Exxon Company, which comprises a narrow cut of isoparaffinic hydrocarbons, comprising essentially 56% isodecane, having ten carbon atoms (C-10), 12% C-9, and 32% C-11. The dispersant is of exceptionally high purity with substantially no toxic impurities, such as normal hexane or benzene, and no objectionable impurities such as sulphur which might poison the platinum catalyst or otherwise be oxidized to sulphur dioxide. Of the possible mixtures of isoparaffinic hydrocarbons, Isopar G has the advantage of the lowest self-oxidation temperature of only 560° F.

We have found that even with a closely spaced reverse roller 106 operating at a high shearing speed, the amount of free carrier or dispersant which must be evaporated from a copy sheet 64 is approximately 0.1 gram or 0.00022 pound. The heat released by complete oxidation of isodecane is somewhat more than 20,000 BTU per pound. Accordingly, the quantity of heat released by oxidation of the carrier of one copy sheet is 20,000 (0.00022)=4.4 BTU per copy. Perfect oxidation requires slightly less than 15 pounds of fresh air per pound of dispersant. We provide some excess air to ensure complete oxidation and thus may provide 18 pounds of fresh air per pound of carrier evaporated. Accordingly, for each copy sheet, a quantity of 0.00022 (18)=0.004 pound of fresh air may be provided.

The scorching temperature of paper is approximately 350° C. or 660° F. To ensure that a copy sheet inadvertently caught within unit 19 does not scorch, we may limit the temperature of the gases issuing from the main catalyst bed to 660° F.

In the following approximate air standard examples, we assume that the products of oxidation have a specific heat at constant pressure of 0.24 BTU per pound −°F., which is the same as that of air, since both air and the products of oxidation comprise 80% nitrogen. We may further assume for the moment that the carrier vapors and products of oxidation flow essentially through the main catalyst bed and that fresh air flowing under lips 32*a* and 32*b* flows essentially through beds 60 and 62 and pipes 46 and 48 where the relatively cool fresh air mixes with the stream issuing from the main catalyst bed and enters the inlet 38 of impeller 16.

For a first example, assume the temperature of the carrier vapors and products of oxidation entering the main catalyst bed is 400° F. The temperature rise in the main catalyst bed is 660° −400° =260° F. Since 4.4 BTU are available for each copy sheet, the quantity of gases recirculated for each copy sheet is 4.4/(260(0.24))=0.0705 pound per copy. The fresh air passing under lips 32*a* and 32*b* may be warmed from a room temperature of 70° for example at inlet 13 to a temperature of perhaps 100° F. in cooling the insulation layer 38 surrounding the main shell 32. Accordingly, the temperature of the mixed gas streams at inlet 37 is $(0.0705(660)+0.004(100))/(0.0705+0.004)=630°$ F. This same temperature of 630° F. exists at the outlet of impeller 16 and of the opposed nozzles 35*a* and 35*b*.

For a second example, assume the temperature of the gases and carrier vapors entering the main catalyst bed is 450° F. The temperature rise in the main catalyst bed is $660°-450°=210°$ F. The quantity of gases recirculated per copy will be slightly greater than before and is $4.4/(210(0.24))=0.0873$ pound per copy. The temperature at inlet 38 resulting from the mixture of the hot gases issuing from the main catalyst bed and the fresh air stream flowing through beds 60 and 62 and pipes 46 and 48 is now $(0.0873(660)+0.004(100))/(0.0873+0.004)=635°$ F.

By ensuring that the temperature of gases issuing from the main catalyst bed is greater than 560° F., which is the auto-oxidation temperature of Isopar G, our preferred liquid carrier or dispersant, we ensure perfect oxidation even though the catalyst bed may have been largely poisoned or otherwise rendered inactive.

The minimum activation temperature for the catalyst beds is in the range of 200° to 220° C. or 390° to 430° F. Preheaters 58 are provided to achieve this activation temperature. The maximum continuous operation temperature of the catalyst beds is 500° to 600° C. or 930° to 1,100° F. Above this temperature range, the thin platinum films tend to migrate and form crystals which reduces the available surface area and exposes the underlying silica wool.

Figure 5:
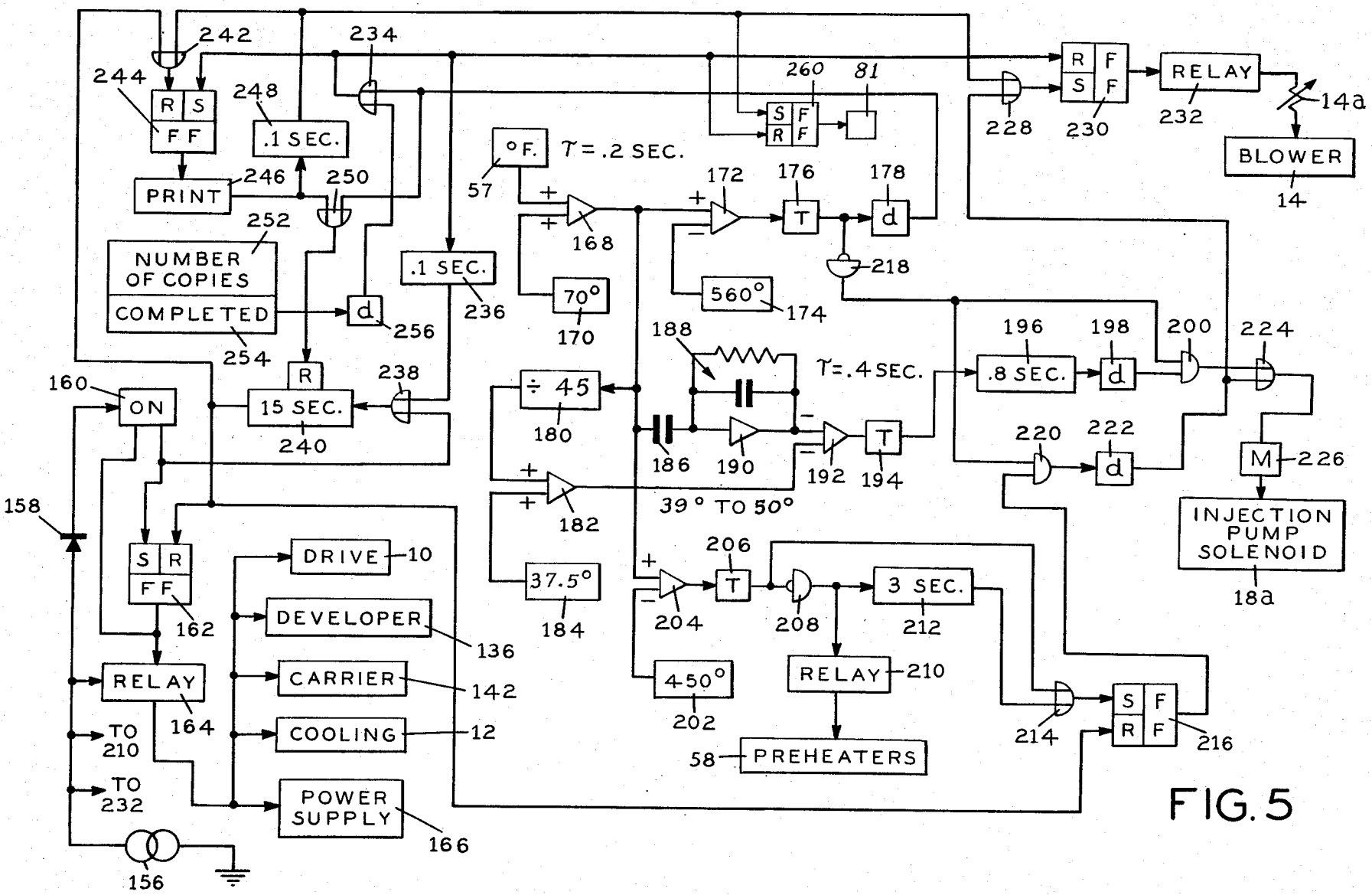
FIG. 5 is an electrical schematic view.

Referring now to FIG. 5, a 120 volt alternating-current source 156, such as a wall plug capable of supplying 6.3 amperes continuously and 8.6 amperes for six seconds is coupled forwardly through a rectifier 158 to a double-pole, single-throw spring loaded "on" switch 160. One pole of switch 160 is directly connected to the energizing winding of a relay 164 which is also supplied by source 156. Momentary depression or actuation of switch 160 energizes relay 164; and AC source 156 is applied to main drive motor 10, developer pump motor 136, carrier pump motor 142, cooling blower motor 12, and to an electronic direct-current power supply 166, which excites inter alia flip-flop 162. The other pole of "on" switch 160 sets flip-flop 162, which maintains relay 164 energized even though spring-loaded switch 160 is subsequently released or deactivated. The second pole of switch 160 is also coupled through an OR circuit 238 to initiate a fifteen second timer 240.

A sensor 57 is mounted above the main catalyst bed to detect the temperature of the gaseous products of oxidation. Sensor 57 may comprise the hot junction of a thermocouple, the cold junction of which is mounted in some cool portion of the electrophotocopier which may be at a temperature of 70° F., for example. The thermocouple hot junction 57 preferably has a short time-constant of 0.2 second and may comprise round wires having a diameter of 1.5 mils or flat ribbon wires having a thickness of roughly 1.6 mils. The hot junction 57 provides an electrical output proportional to temperature difference from the cold junction temperature of perhaps 70° F. Circuit 170 provides a constant voltage scaled to represent the cold junction temperature of 70° F. The output of thermocouple 57 and of circuit 170 are applied to the inputs of a summing amplifier 168 which provides an electrical output proportional to the temperature of hot junction 57 in °F. The output of amplifier 168 is coupled to one input of a differential amplifier 204 which receives another input from a voltage source 202 scaled to represent a temperature of 450° F., which is somewhat beyond the temperature range of 390° to 430° F. required to activate the catalyst beds.

Assuming that the electrophotocopier has not been used for an extended time, the temperature within the unit 19 will be substantially 70° F.; and amplifier 204 provides a negative output which drives a Schmitt trigger circuit 206 to produce a zero output. The output of trigger circuit 206 is applied to an inverting amplifier 208 which in turn actuates relay 210. Relay 210 is supplied with alternating current from source 156 and excites the preheaters 58. The preheaters may reach still air equilibrium temperature in 3.5 seconds and may accordingly be formed of wires having a diameter of about seven mils. To heat these wires in still air to a temperature of 2,000° F. requires a current of 2.35 amperes Six wires may be provided, one for each of beds 60 and 62 and four wires for the main catalyst bed. Each wire may have a length of eight inches, allowing one-half inch for the spring suspension to maintain each wire reasonably taut despite expansion with temperature. Nichrome V has a resistivity of 650 ohm-circular mils per foot. The resistance of the six wires connected in series is accordingly $6(650/49)(8/12)=52$ ohms; and the current drawn from a 120 volt source is $120/52=2.3$ amperes. The power consumption of the preheaters is only $120\ (2.3)=276$ watts.

The output of inverter 208 is applied to a circuit 212 which after a time delay of three seconds supplies an output which is coupled through OR circuit 214 to set flip-flop 216. At this time preheaters 58 may have reached a temperature of only 1400° F., some 600° F. less than their equilibrium temperature in still air.

The output of amplifier 168 is coupled to a differential amplifier 172 which also receives an input from a voltage source 174 which is scaled to represent a temperature of 560° F., corresponding to the auto-oxidation temperature of the carrier dispersant. Initially, the output of amplifier 168 represents only 70° F.; and comparator 172 provides a negative output which actuates trigger circuit 176 to produce a zero output. This zero output from trigger circuit 176 is applied to inverter 218, the output of which partially enables AND circuits 200 and 220.

The setting of flip-flop 216 provides an output which is coupled through enabled AND circuit 220 to a differentiating circuit 222 which provides an output pulse. The output pulse from differentiating circuit 222 is applied through OR circuit 228 to set flip-flop 230. Flip-flop 230 energizes the winding of relay 232, which relay is also supplied with alternating current from source 156. Alternating current from relay 232 is applied through an adjustable rheostat 14*a* to blower motor 14. Impeller 16 causes the air within unit 19 to flow upwardly through the catalyst beds at a velocity in the range, for example, from 10 to 30 feet per second. This air flow prevents preheater wires 58 from reaching their still air equilibrium temperature of 2,000° F. and holds them at a temperature in the vicinity of perhaps 1400° F.

The kinematic viscosity of air at 70° F. is approximately $1.63(10^{-4})$ feet squared per second; and the Reynolds number associated with a flow at perhaps 20 feet per second past heater wires having a diameter of 0.007 inch is $20(0.007/12)/1.63(10^{-4})=72$. Since the flow past a round wire becomes turbulent only for Reynolds numbers above 400,000, the flow past the heater wires is laminar.

The fibers of the silica wool catalyst beds have an extremely small diameter averaging eight microns or 0.32 mil. The Reynolds number associated with the flow through the catalyst fibers is thus roughly 5% of that associated with the flow through the heater wires. In the absence of air flow, the catalyst in the vicinity of each heater wire would also have a temperature of 1,400° F. by direct radiation. When air is circulated through the catalyst beds, some cooling of the catalyst occurs; and each preheater wire 58 may be surrounded by a first cylindrical region of catalyst at a temperature of perhaps 1100° F., the upper limit of the temperature range for continuous operation of the catalyst beds. The diameter of this first cylindrical region may be roughly 0.1 inch depending of course upon the density or degree of compaction of the silica wool. The catalyst temperature falls as the distance from a heater wire increases. For example, the catalyst within a second cylindrical region of 0.2 inch diameter surrounding each preheater wire may be at a temperature of at least 560° F., which is the self-oxidation temperature of our preferred liquid carrier; and the catalyst within a third cylindrical region of 0.3 inch diameter surrounding each preheater wire may be at a temperature of at least 390° F., which is the minimum activation temperature for the catalyst.

The pulse from differentiating circuit 222 is also coupled through OR circuit 224 to a monostable multivibrator 226 which provides a pulse to the solenoid 18*a* of the injection pump 18. A fine spray of atomized droplets of dispersant issues from nozzle 44 adjacent the periphery of impeller 16 which are carried through nozzle 35*b* and then flow upwardly through the main catalyst bed for the most part and also through auxiliary bed 62. Dispersant droplets passing through the first or second regions are auto-oxidized; and dispersant droplets passing through the third region are oxidized by the activated catalyst. Droplets of dispersant not oxidized during a first passage through the catalyst beds will be oxidized on a second or subsequent passage therethrough, so that within a time interval of perhaps 0.2 second substantially all the injected carrier will have been oxidized.

The length of unit 19 between lips 32*a* and 32*b* may be 9 inches; the width between the sidewalls 22 and 23 may be 8.5 inches to accommodate a corresponding width of copy paper; and the average height of unit 19 between the copy paper 64 and the upper surface of shell 32 may be approximately 3 inches. The volume of air contained within unit 19 is thus $3(8.5)(9)/1728=0.133$ cubic feet. The air inside unit 19 is initially at a temperature of 70° F. or 530° R.; and the specific volume is $53.3(530)/(14.7(144))=13.3$ cubic feet per pound. The weight of air initially within unit 19 is thus $0.133/13.3=0.01$ pound.

The catalyst pads may have an uncompacted height of three centimeters and may be compacted to a height of two centimeters by the fabric layers. The width of the catalyst pads is 8.5 inches; and their total length may be 8 inches. The catalyst pads have a very low density; and the total weight of the three pads may be 3.6 grams or 0.008 pound. The fabric layers may be made of glass cloth weighing one ounce per square yard; and the total cloth weight is $2(8)(8.5)/(16)(144)(9)=0.0065$ pound. The specific heat of the silica pads is 0.19; and the specific heat of the glass cloth is roughly the same.

The large surface areas of the catalyst pads and of the fabric layers causes these two elements almost immediately to assume substantially the temperature of the gases within the unit 19; and the three elements—the gases, the pads, and the fabric layers—are tightly coupled. The total weight of the catalyst bed assemblies comprising the catalyst pads and the fabric layers is $0.008+0.0065=0.0145$ pound; unit 19 initially contains 0.01 pound of air; and the initial "thermal mass" of the three tightly coupled elements is $0.01(0.24)+0.0145(0.19)=0.00515$ BTU per °F. To produce a temperature rise of 78° of the three tightly coupled elements requires an amount of heat of $78(0.00515)=0.4$ BTU. For each stroke of solenoid 18*a*, pump 18 should provide a quantity of carrier liquid of $0.4(100)/4.4=9.1$ milligrams, or 9.1% of that on one copy sheet. The initial actuation of pump 18 causes the temperature within unit 19 to rise from 70° F. to 148° F. or 608° R.

The output of amplifier 168 is coupled through an input capacitor 186 to the input of a high negative gain amplifier 190 provided with a feedback circuit 188 comprising a capacitor shunted by a resistor. The capacitor of feedback circuit 188 may have the same value as the input capacitor 186; and the resistor of feedback circuit 188 is such as to provide an R-C time-constant of 0.4 second or twice that of temperature sensor 57. The 78° temperature change within unit 19 produces a corresponding change in the output of amplifier 168; and amplifier 190 initially provides a negative output substantially equal to this temperature change.

The output of amplifier 168 is coupled to a circuit 80 which divides the voltage by a factor of 45. The output of voltage divider 180 is coupled to one input of a summing amplifier 182 which receives a second input from a voltage source 184 scaled to represent a temperature increment of 37.5°. The initial output of amplifier 182 is accordingly a voltage representing a temperature of $37.5+70/45=39°$, which represents only half the initial temperature rise of 78°.

The outputs of amplifiers 190 and 182 are coupled to the inputs of a negative summing amplifier 192. Before the actuation of solenoid 18*a*, the positive output from amplifier 82 provides a negative output from amplifier 192, causing a zero output from tigger circuit 194. As soon as the output from amplifier 190 becomes more negative than a voltage equivalent to 39°, the output of amplifier 192 becomes positive, causing trigger circuit 194 to provide an output which is applied to a circuit 196 providing a time delay of 0.8 second, or twice the time-constant of feedback circuit 188. During the time delay provided by circuit 196, the resistor of feedback circuit 188 causes the output of amplifier 190 to return substantially to zero. Circuit 196 then provides an output which is applied to a differentiating circuit 198.

It will be recalled that AND circuit 200 is enabled by inverter 218 when the electrical output of amplifier 168 represents a temperature less than 560° F. Differentiating circuit 198 provides a pulse which is coupled through enabled AND circuit 200 and OR circuit 224 to multi-vibrator 226, which pulses injection pump solenoid 18*a* a second time. Since the gases within unit 19 are now at a temperature of 608° R. instead of the initial temperature of 530° R., the weight of gas contained within unit 19 is $0.01(530/608)=0.0087$ pound. The thermal mass of the three tightly coupled elements is now $0.0087(0.24)+0.0145(0.19)=0.00485$ BTU per °F. The 0.4 BTU released by oxidizing the 9.1 milligrams of carrier injected upon the second actuation of solenoid 18*a* results in a temperature rise of $0.4/0.00485=82°$ to 230° F.

Immediately prior to second actuation of solenoid 18*a*, amplifier 182 provides a reference level to amplifier 192 of 37.5+148/45=41°, or half the expected temperature rise. When amplifier 190 provides an output corresponding to half the expected temperature rise, the output of amplifier 192 becomes positive; and trigger circuit 194 provides a pulse to delay circuit 196. During the delay interval, the output of amplifier 190 returns to zero; the output of amplifier 192 becomes negative; and the output of trigger circuit 194 returns to zero or ground potential. Circuit 196 then provides an output; and differentiating circuit 198 couples a pulse through enabled AND circuit 200 and OR circuit 224 to trigger multi-vibrator 226 a third time. The temperature of the gases within unit 19 rises by 86° to 316° F. Solenoid 18*a* is similarly actuated a fourth time to produce a temperature rise of 90° to a temperature of 406° F. A fifth actuation of solenoid 18*a* results in a temperature rise of 94° to a temperature of 500° F.

When the output of amplifier 168 represents a temperature greater than 450° F., the output of amplifier 204 becomes positive, causing trigger circuit 206 to provide a positive output. Inverter 208 disables relay 210, turning off the preheaters 58, which have been energized for a period of only 3+4(0.8)=6.2 seconds.

A sixth pulse of solenoid 18*a* increases the temperature by 98° to 598° F. nominally. The temperature will, however, be appreciably less than this since some heat is lost to shells 32 and 36, for example, which gradually raises their temperature from 70° F. Thus after six strokes of solenoid 18*a*, the temperature within unit 19 may be only 559° F. or 1019° R. At this time amplifier 182 provides a reference of 37.5+559/45=50° F. Delay circuit 196 actuates solenoid 18*a* a seventh time. The weight of gases in unit 19 is 0.01(530/1019)=0.0052 pound; and the thermal mass is 0.0052(0.24)+0.0145(0.19)=0.004 BTU per °F. The release of 0.4 BTU from oxidation of injected carrier results in a temperature rise of 0.4/0.004=100° to substantially 660° F. The total quantity of dispersant injected is 7(9.1)=63.7 milligrams, or 63.7% of that on one copy sheet; and 7(0.4)=2.8 BTU is released to raise the temperature of the three tightly coupled elements to 660° F.

The preheaters supply 276 watts for 6.2 seconds which represents 276(6.2)/1055=1.62 BTU. This heat is also supplied to the three tightly coupled elements which are but loosely coupled thermally to other portions of unit 19 such as shells 32 and 36. As previously indicated, there is a continual flow of heat from the gases to these shells which gradually increases their temperatures from 70° F. To simplify the description of warm-up operation, we have assumed somewhat optimistically that the heat flow from the gases to the shells is only slightly more than the heat flow from the preheaters to the three tightly coupled elements. The three tightly coupled elements have a low thermal mass and may rapidly be brought to operating temperature even though the shells, which have a large thermal mass, have not reached their equilibrium temperatures.

When the output of amplifier 168 exceeds 560° F., the output of amplifier 172 becomes positive, causing trigger circuit 176 to provide an output. A positive output of trigger circuit 176 disables inverter 218 which disables AND circuits 200 and 220. The disabling of AND circuit 200 occurs immediately after the seventh actuation of solenoid 18*a*; and no eighth pulse can be coupled through AND circuit 200.

The output of trigger circuit 176 is applied to a differentiating circuit 178, the output of which is coupled through OR circuit 234 to reset flip-flop 230, which disables relay 232 and turns off blower 14. The output of OR circuit 234 also sets flip-flop 244 from a "wait" condition to a "ready" condition. The output of differentiating circuit 178 is also coupled through an OR circuit 250 to reset the fifteen second timer 240. The output of OR circuit 234 is further applied to a 0.1 second delay circuit 236, the output of which is coupled through OR circuit 238 to initiate a further fifteen second time interval of circuit 240.

Summarizing the operation thus far, three seconds after "on" switch 160 is momentarily depressed, solenoid 18*a* receives an initial or first pulse from differentiating circuit 222. The subsequent second through seventh pulses of solenoid 18*a* are coupled through differentiating circuit 198 and occur at 0.8 second intervals. The total time elapsed from the depression of "on" switch 160 until the setting of "ready" flip-flop 244 is 3+6(0.8)=7.8 seconds.

The actuation of flip-flop 244 enables "print" switch 246. The operator has meanwhile actuated selector 252 for the desired number of copies and placed the original to be copied upon platen 88. If the operator delays actuating "print" switch 246 for fifteen seconds, timer 240 provides an output which resets flip-flop 244, resets flip-flop 216 and resets flip-flop 162, which disables relay 164 and turns the electrophotocopier off. It may be noted that the fifteen second timer 240 will also turn the machine off in the event unit 19 is not brought up to a temperature exceeding 560° F. This may occur if relay 210 or one of the serially-connected preheaters 58 have failed or, more likely, if container 150 has been fully depleted of its supply of carrier dispersant. The initial actuation of solenoid 18*a* from differentiating circuit 222 will thus result either in no carrier being injected or no oxidation of the carrier if it has been injected. In such event, no temperature rise will be detected by amplifier 190; solenoid 18*a* will not receive any further pulses from differentiating circuit 198; and no further carrier will be injected. Timer 240 will turn off the machine fifteen seconds after depression of "on" switch 160 unless "ready" flip-flop 244 has previously been set to initiate a further fifteen second time interval.

If the operator again depresses "on" switch within a short time interval, the temperature within unit 19 will still be in excess of 560° F. Amplifier 172 will immediately provide a positive output which, through trigger circuit 176 and differentiating circuit 178, sets "ready" flip-flop 244.

If the operator waits an appreciably longer period of time before depressing "on" switch 160, the temperature within unit 19 may have fallen within a range above 450° F. but less than 560° F. In such event, amplifier 204 provides an immediate positive output to trigger circuit 206, the output of which is coupled through OR circuit 214 immediately to set flip-flop 216. When the output of amplifier 168 is less than 560° F., the output of amplifier 172 is negative; and the absence of an output from trigger circuit 176 causes inverter 218 to enable AND circuits 200 and 220. The output of flip-flop 216 is coupled through AND circuit 220 to differentiating circuit 222, which provides a pulse through OR circuit 224 to multivibrator 226 which pulses solenoid 18*a*. If this first pulse does not result in a temperature above 560° F., then differentiating circuit 198 will pulse solenoid 18*a* a second time, which will surely result in a temperature exceeding 560° F.

If the operator waits still longer before depressing "on" switch 160, the temperature within unit 19 may fall below 450° F. In such event, the output of amplifier 204 will be negative; preheaters 58 will be energized; and a three second delay provided by circuit 212 will occur before flip-flop 216 is set to provide the first pulse to solenoid 18*a*.

When "ready" flip-flop 224 is set, actuation of "print" switch 246 couples a signal through OR circuit 250 to reset the fifteen second timer 240. The output from print switch 246 is coupled to a 0.1 second delay circuit 248, the output of which is coupled through OR circuit 242 to reset flip-flop 244 to a "wait" condition. The output of delay circuit 248 is also coupled through OR circuit 228 to set flip-flop 230 and thereby energize relay 232 to actuate blower 14. When the initial portion of the first copy sheet 64 enters unit 19, the hot gases recirculating therewithin evaporate the thin layer of carrier liquid transferred to copy sheet concomitantly with the developed image; and the heat evolved upon oxidation of the carrier vapor in the catalyst beds maintains the temperature within unit 19 for the drying and fixing of subsequent portions of the first copy sheet. When a number of copies corresponding to selector 252 has been completed, an output is produced from circuit 254 which is applied to differentiating circuit 256. The resulting pulse from circuit 256 is coupled through OR circuit 234 to set flip-flop 244 to a "ready" condition and reset flip-flop 230, which disables relay 232 and blower 14. The output of OR circuit 234 after a 0.1 second delay provided by circuit 236 is applied through OR circuit 238 to initiate fifteen second timer 240. Blower 14 operates only in bringing unit 19 up to operating temperature or when copies are being made. At all other times blower 14 is off to conserve the heat within unit 19.

After a copy sheet has been picked off from drum 100 and passes around roller 110, the surface of drum 100 is cleaned by roller 114 which rotates counterclockwise. Roller 114 preferably has closed interior cells, to prevent absorption of liquid developer, and open exterior cells to provide effective scrubbing of the photoconductive surface so that untransferred portions of the developed image are removed. Developer liquid may be supplied to cleaning roller 114 by a further pipe, not shown, from the outlet of pump 138. A cleaning blade 116, formed of an electrically conductive rubber and provided with an electrical bias, further assists in cleaning the photoconductive surface of drum 100 before it again passes under the charging corona 102.

Under conditions of extreme humidity, each copy sheet 64 may contain an unusual amount of water which must be evaporated along with the carrier dispersant. The high latent heat of vaporization of water may cause the temperature at the outlet of the main catalyst bed to drop below 560° F. during the production of a large number of copies. If this occurs, the output of amplifier 172 will become negative; and the output of trigger circuit 176 will revert to ground potential. This produces an output from inverter 218 which in conjunction with the output from flip-flop 216 enables AND circuit 220. A pulse from differentiating circuit 222 is coupled through OR circuit 224 to multivibrator 226. Solenoid 18*a* is actuated; and the temperature at the outlet of the main catalyst bed increases by 100° to substantially 660° F.

The oxidation of carrier vapor evolves 4.4 BTU for each copy sheet. Since each copy sheet requires 0.004 pound of fresh air, a corresponding weight of substantially 0.004 pound of oxidation products must be exhausted for each copy sheet. These oxidation products at the outlet of impeller 16 which flow through nozzle 84*a* are at a temperature of approximately 630° F. The heat lost in the exhaust is thus (630-70)(0.24)(0.004)=0.54 BTU per copy. The thermal efficiency is accordingly 1-0.54/4.4=87.7%, neglecting residual heat losses through the insulating layer 38 for the main shell and heat carried out of unit 19 by belt 66. The oxidation of the carrier liquid on each copy sheet thus results in 4.4-0.54=3.86 BTU available to dry each copy sheet and fix the transferred image.

A high-speed electrophotocopier producing sixty copies per minute, produces 3600 copies per hour. The effective or useful heat output rate of unit 19 is thus 3600(3.86)/3413=4.1 kilowatts. To provide this power by electrical heaters operating at 120 volts would require 34 amperes; and 17 amperes would be required if special 220 volt electrical service were installed.

It will be recalled that in the first example, the inlet temperature of the catalyst beds was assumed to be 400° F.; and 0.0705 pound of products of oxidation were recirculated for each copy. In the second example, the inlet temperature of the catalyst beds was assumed to be 450° F.; and 0.0873 pound of products of oxidation were recirculated for each copy. For an electrophotocopier capable of producing a given number of copies per minute, the weight of products of oxidation recirculated per copy is proportional to the speed of impeller 16, which may be governed by rheostat 14*a*. Rheostat 14*a* may be adjusted such that with the machine continually producing copies, the output of amplifier 168 corresponds to a temperature of 660° F. If the output of amplifier 168 represents less than 660°, rheostat 14*a* should be adjusted to a higher resistance, decreasing the speed of motor 14 and impeller 16, and reducing the weight of products of oxidation recirculated per copy to increase the temperature at the outlet of the main catalyst bed. If on the other hand amplifier 168 provides an output corresponding to a temperature greater than 660° F., then rheostat 14*a* should be adjusted to a lower resistance, increasing the speed of impeller 16, and recirculating a greater weight of products of oxidation for each copy to decrease the outlet temperature of the main catalyst bed.

Any change in the speed of impeller 16 with adjustment of rheostat 14*a* correspondingly changes the velocity of exhaust flow through nozzle 82*a*. Accordingly, nozzle 82*a* must be readjusted to vary the exhaust area to maintain the weight of products of oxidation exhausted at a nominal value of 0.004 pound per copy. Thus if nozzle 82*a* were originally set to the proper exhaust area and rheostat 14*a* is subsequently adjusted to a decreased resistance to increase the speed of impeller 16, nozzle 82*a* must correspondingly be readjusted to provide a somewhat reduced exhaust area, as by screwing it clockwise from above to move it downwardly upon body 82 so that the annular gap between the nozzle and the tapered needle mounted on body 82 is reduced.

At a temperature of 100° F. or 560° R., the warmed fresh air flowing into unit 19 has a specific volume of 13.3(560/530)=14.1 cubic feet per pound. For a machine producing sixty copies per minute, or one copy per second, the speed of belt 66 may be 1.5 feet per second, assuming the length of a copy sheet is 11.5 inches and that carriages 90 and 92 are returned at the end of each scan to their initial positions at twice their forward scan velocities. To prevent hot gases and unoxidized carrier vapors from being carried out of unit 19 in the boundary layer adjacent a copy sheet, the velocity of fresh air flowing into unit 19 under lips 32*a* and 32*b* should be greater than the speed of belt 66 and may be 8 feet per second, for example. The volume rate of flow of fresh air is 14.1(0.004)=0.056 cubic feet per second. The fresh air inlet area should be 144(0.056/8)=1 square inch; and the gap between each of lips 32*a* and 32*b* and the copy sheet may be 1/(2(8.5))=0.06 inch.

The correct angles for nozzles 35*a* and 35*b* depends upon the area of the auxiliary catalyst beds 60 and 62 compared to that of the main catalyst bed. It is desired that the pressure under the main catalyst bed be substantially atmospheric. No products of oxidation and unoxidized carrier vapors will escape from beneath the main catalyst bed through the small clearance gaps between belt 66 and sidewalls 22 and 23. Nor will cool ambient air flow into the region under the main catalyst bed through these clearance gaps and prevent drying of the margins of the copy sheet. The pressure under the auxiliary catalyst beds 60 and 62 should be slightly less than atmospheric to induce a flow of partially heated air under lips 32*a* and 32*b*. If each auxiliary catalyst bed 60 and 62 has an area or length equal to 50% of that of the main catalyst bed, then nozzles 35*a* and 35*b* may be directed almost normal to copy sheet 64 with a small convergence angle. In the degenerate and undesired limiting case that the auxiliary catalyst beds 60 and 62 were omitted entirely, then nozzles 35*a* and 35*b* should be directed toward one another substantially parallel to copy sheet 64.

The slight subatmospheric pressure beneath the auxiliary catalyst beds 60 and 62 which induces a flow of fresh air under lips 32*a* and 32*b* also causes cool air to leak into these regions through the small clearance gaps between belt 66 and sidewalls 22 and 23. It is preferable that the area or length of each auxiliary catalyst bed be less than 50% of that of the main catalyst bed to reduce this cool air leakage which tends to prevent complete drying of the margins of the copy sheet. The areas or lengths of the auxiliary catalyst beds should, however, not be so small that their outlet temperature is less than 560° F., which is a self-oxidation temperature of our preferred carrier dispersant. The outlet temperature of the auxiliary catalyst beds will always be somewhat less than that of the main catalyst bed, since the fresh air passing under lips 32*a* and 32*b* flows essentially through the auxiliary catalyst beds.

The weight of products of combustion and vapor flowing through the auxiliary catalyst beds should be at least 0.0184 pound per copy. The outlet temperature of the auxiliary catalyst beds will thus be at least (0.0184(660)+0.004(100))/(0.0184+0.004)=560° F. In the first example where 0.0705 pound of products of oxidation is recirculated for each copy sheet, the areas of the auxiliary catalyst beds should be at least 0.0184/(0.0705−0.0184)=35.4% of that of the main catalyst bed; and each auxiliary catalyst bed should have an area at least 17.7% of that of the main catalyst bed. In the second example, where 0.0873 pound of products of oxidation is recirculated for each copy sheet, the areas of the auxiliary catalyst beds should be at least 0.0184(0.0873−0.0184)=26.8% of that of the main catalyst bed; and each auxiliary catalyst bed should have an area at least 13.4% of that of the main catalyst bed.

In FIG. 2, a spring-biased rotary electromagnetic actuator, secured to the interior of shell 40, controls a valve plate 83 which normally covers the inlet to exhaust body 82. When unit 19 is being brought up to operating temperature, valve plate 83 prevents gases from being exhausted from nozzle 82*a*. During any period the electrophotocopier is off, the products of combustion will either condense or diffuse from unit 19; and oxygen will diffuse into unit 19. In bringing unit 19 up to a temperature of 660° F., pump 18 injects 63.7 milligrams of dispersant which requires 0.637(0.004)=0.0025 pound of air for oxidation. At a temperature of 660° F. or 1120° R., unit 19 contains 0.01(530/1120)=0.0047 pound of gases, of which 0.0047−0.0025=0.0022 pound may be considered as "fresh air". No fresh air flow under lips 32*a* and 32*b* is needed or desired during warm-up. Valve plate 83 prevents the exhausting of any gases through nozzle 82*a* and substantially prevents fresh air flow under lips 32*a* and 32*b* during warm-up.

In FIG. 5, actuation of print switch 246 couples a signal through delay circuit 248 to set flip-flop 260, which excites actuator 81 to rotate valve plate 83 away from the inlet to body 82. This permits the exhausting of gases from unit 19 and a corresponding flow of fresh air under lips 32*a* and 32*b*. When a number of copies corresponding to selector 252 is completed, the output from circuit 254 is coupled through differentiating circuit 256 and OR circuit 234 to reset flip-flop 260 and disable actuator 81. Valve plate 83 rotates under its spring bias back to the normal position shown where it again blocks the inlet to body 82.

When impeller 16 is not rotating, the pressure within unit 19 is atmospheric. The cooling air from impeller 11 discharged adjacent lips 32*a* and 32*b* would normally create a positive pressure immediately outside these lips, tending to force cool air into unit 19 even though impeller 16 is not rotating. Vanes 33*a* and 33*b* extend at least partially into the outlet passages for cooling air, and deflect the cooling air sufficiently away from lips 32*a* and 32*b* that the pressure under the deflecting vanes and immediately outside lips 32*a* and 32*b* is substantially atmospheric. Thus, with impeller 16 stationay, cooling air through impeller 11 will cause neither a flow of cool air into unit 19 nor an exhausting of the hot gaseous products therein.

It will be seen that we have accomplished the objects of our invention. Our electrophotocopier catalytically oxidizes a dielectric hydrocarbon carrier liquid dispersant driven from the copy sheet during drying and fixing of the transferred image into harmless oxidation products. Our liquid hydrocarbon carrier preferably contains a major portion of isodecane to achieve a minimum self-oxidation temperature of 560° F. The hydrocarbon dispersant is highly purified and contains a negligible amount of toxic impurities such as normal hexane and benzene; but even these are oxidized into harmless products. The heat resulting from this catalytic oxidation is utilized to dry the copy sheet and fix the transferred image. The heat is preferably utilized directly; and the hot gaseous oxidation products are directed against the copy sheet. We prefer not to use heat exchangers, since such heat exchangers have a large thermal inertia and increase the warm-up time. Our catalyst beds, comprising fine silica wool fibers coated with platinum, have a relatively low minimum activation temperature of 390° F. and a relatively high continuous operating temperature of 1100° F. Imbedded electrical preheater wires bring surrounding regions of the catalyst at least to minimum activation temperature and preferably to maximum operating temperature in less than three seconds with a temporary and relatively low electrical power consumption of 276 watts. Our drying and fixing unit has a rapid warm-up time and is brought to a temperature exceeding the auto-oxidation temperature of the carrier dispersant in approximately 7.8 seconds by successively injecting a small quantity of the carrier dispersant through an atomizing spray nozzle. The time required to produce a first copy from initial start-up is approximately 8.8 seconds. The temperature at the catalyst outlet is monitored; and the auxiliary carrier injection pump operates as may be needed to maintain the catalyst outlet at a temperature exceeding the auto-oxidation temperature of the carrier dispersant under high humidity conditions where large quantities of water must be evaporated from the copy sheets. Each copy sheet is securely held to the conveyor belt by providing such belt with porosity, as by perforating it, in conjunction with a vacuum system actuated by the impeller which recirculates the products of oxidation. The vacuum pressure is made reasonably high by providing the catalyst beds with closely woven fabric retainers. The speed of the impeller is variable to control the weight of products of oxidation recirculated per copy sheet and thus control the outlet temperature of the catalyst beds. Our unit is provided with a main and two auxiliary catalyst beds; and the outlet of the recirculating impeller is directed to a pair of nozzles each extending the full width of the copy sheet and disposed on either side of the main catalyst bed, between it and the auxiliary catalyst beds. The auxiliary catalyst beds each have an area relatively small compared with that of the main catalyst bed, to reduce marginal leakage, but sufficiently large to ensure that the outlet temperature of the auxiliary catalyst beds exceeds the auto-oxidation temperature of the carrier dispersant. The outlet nozzles of the recirculating impeller are directed toward one another. This ensures that the pressure under the main catalyst bed is substantially atmospheric, to prevent leakage, and that the pressure under the auxiliary catalyst beds is slightly less than atmospheric to induce a flow of fresh oxygen containing air into the region under the auxiliary catalyst beds. Our drying and fixing unit is provided with a layer of heat insulating material to reduce residual heat losses; and the unit is provided with an outer shell spaced from the insulating layer into which cooling air is forced. The heated cooling air is regeneratively employed as the fresh air source; and the cooling air is discharged adjacent the fresh air inlets to the unit. The fresh air inlets are sufficiently close to the copy sheet that the inlet air velocity is greater than the transport speed of the copy sheet so that hot gases are not carried out of the unit in the boundary layer adjacent a copy sheet. The heated cooling air is deflected by discharge vanes so that the fresh air inlets to the unit are substantially at atmospheric pressure; and the circulation of cooling air neither assists nor inhibits flow of fresh air into the unit. The quantity of fresh air flowing into the unit is governed by a variable area exhaust nozzle positioned at the outlet of the recirculating blower. The exhaust nozzle is adjusted to provide approximately 20% excess air to ensure complete oxidation of the carrier dispersant vaporized in drying and fixing a copy sheet. Our unit has a high thermal efficiency of nearly 87.7%. The usable heat output is directly proportional to the number of copies per minute; and for an electrophotocopier capable of producing sixty copies per minute, the useful output available for heating copy sheets is four kilowatts, which is obtained with minimal electrical power consumption. Our drying and fixing unit, while somewhat larger than conventional electrically powered electrophotocopier heaters is nevertheless minuscule in size compared with systems for oxidizing the solvent-based inks in the rotogravure and color printing press art. Our unit may occupy an area of less than 80 square inches and have a volume less than 240 cubic inches. The recirculating blower is turned on only in bringing the unit up to operating temperature and when copies are actually being produced. At all other times the recirculating blower is off to conserve heat. The exhaust nozzle inlet is blocked during warm-up and is opened only when copies are being produced. The cooling air forced between the insulating layer and the outer shell maintains the outer shell reasonably cool to the touch. The hot, high velocity exhaust gases are reduced both in temperature and velocity by an ejector; and the hand may be placed into the ejector exhaust without discomfort. Our unit is operated at a high temperature but not in excess of the scorching temperature of the copy sheet. In the remote event that a copy sheet becomes jammed within our unit, the sheet may readily be removed by lifting and pivoting the unit about the axis of the downstream belt transport roller adjacent the output tray.

It will be understood that certain features and subcombinations are of utility and may be employed without reference to other features and subcombinations. This is contemplated by and is within the scope of our claims. It will be further obvious that various changes may be made in details within the scope of our claims without departing from the spirit of our invention. For example, the preheater wires may be mounted anywhere in the path of the recirculating gases rather than being imbedded in the catalyst pads. An auxiliary vacuum pump or blower may be provided between manifolds 76 and 78, the inlet of the vacuum blower being connected to manifold 76 and the outlet of the vacuum blower being connected to manifold 78. Such auxiliary pump or blower would provide the reduced pressure for the vacuum bed; and the catalyst beds might then have a low pressure drop, as by providing the fabric layers with a relatively open weave. The carrier liquid for the liquid developer alternatively may be Isopar H or Isopar K, both registered trademarks of the Exxon Company for narrow cuts of isoparaffinic hydrocarbons. Container 150 may have a supply of any catalytically oxidizable hydrocarbon fluid. The fluid may be pressurized liquid butane or propane. In such event, no injection pump is needed; and solenoid 18*a* may instead open valve V permitting gaseous butane or propane to flow through a single flexible conduit into shell 32. Instead of a centrifugal blower 16, we may use a transverse-flow blower or a single or multiple stage axial-flow blower. We may provide only one catalyst bed instead of three beds. We may provide only one of nozzles 35*a* and 35*b*; and the nozzle may be directed parallel to the copy sheet. The vacuum bed may be extended laterally of the direction of transport; and walls 22 and 23 may rest on the laterally extended vacuum bed to reduce marginal leakage into or out of unit 19. Other catalysts such as palladium and rhodium may be used instead of platinum. The temperature of oxidation products may be less than the auto-oxidation temperature of the carrier liquid but should exceed the minimum activation temperature of the catalyst.

Having thus described our invention, what we claim is:

1. An electrophotocopier including in combination means for producing a latent electrostatic image on an imaging surface, means including a liquid developer comprising charged toner particles dispersed in a dielectric liquid hydrocarbon carrier for developing said latent image, means for transferring the developed image from said surface to a copy sheet, means for oxidizing carrier liquid transferred to the copy sheet concomitantly with the developed image to produce hot gaseous oxidation products, and means for directing said hot oxidation products against the copy sheet to dry and fix the transferred image by vaporizing transferred carrier liquid.

2. An electrophotocopier including in combination means for producing a latent electrostatic image on an imaging surface, means including a liquid developer comprising charged toner particles dispersed in a dielectric liquid hydrocarbon carrier for developing said latent image, means for transferring the developed image from said surface to a copy sheet, means for catalytically oxidizing carrier liquid transferred to the copy sheet concomitantly with the developed image, and means utilizing the heat provided by such oxidation to dry the copy sheet and fix the transferred image.

3. Apparatus as in claim 2 wherein the liquid carrier comprises an isoparaffinic hydrocarbon.

4. Apparatus as in claim 2 wherein the liquid carrier comprises a narrow cut of hydrocarbons.

5. Apparatus as in claim 2 wherein the oxidizing means includes a catalyst having a certain minimum activation temperature and provides gaseous oxidation products at a temperature exceeding said minimum activation temperature.

6. Apparatus as in claim 2 wherein the liquid carrier has a certain auto-oxidation temperature and wherein the oxidizing means provides gaseous oxidation products at a temperature exceeding such auto-oxidation temperature.

7. Apparatus as in claim 2 wherein the oxidizing means comprises fine fibers coated with a thin layer of catalyst.

8. Appratus as in claim 2 wherein the oxidizing means comprises fine silica wool fibers coated with a thin layer of catalyst.

9. Apparatus as in claim 2 wherein the oxidizing means includes a catalyst having a certain minimum activation temperature, further including an electrical resistance heating wire and means for passing sufficient current through the wire to heat it to a temperature exceeding said minimum activation temperature.

10. Apparatus as in claim 2 wherein the liquid carrier has a certain auto-oxidation temperature, further including an electrical resistance heating wire and means for passing sufficient current through the wire to heat it to a temperature exceeding said auto-oxidation temperature.

11. Apparatus as in claim 2 wherein the oxidizing means has a certain maximum operating temperature, further including an electrical resistance heating wire and means for passing sufficient current through the wire as would heat it in still air to a temperature exceeding said maximum operating temperature.

12. Apparatus as in claim 2 wherein the copy sheet has a certain scorching temperature and wherein the oxidizing means provides gaseous oxidation products at a temperature less than said scorching temperature.

13. Apparatus for drying a sheet bearing marking material and an oxidizable liquid including in combination means for transporting the copy sheet, a shell disposed adjacent the transporting means, the shell having mounted therein a first and a second and a third oxidizing bed disposed in spaced relationship along the direction of transport and extending laterally thereof, each bed having an inlet and an outlet, a blower having an inlet communicating with the outlet of the second bed and having an outlet, a first and a second nozzle communicating with the blower outlet, the first nozzle being disposed between the first and second beds, the second nozzle being disposed between the second and third beds, each nozzle extending laterally of the direction of transport, first pipe means extending along the direction of transport and piercing the first nozzle, and second pipe means extending along the direction of transport and piercing the second nozzle.

14. Apparatus as in claim 13 wherein the first and third beds have equal areas.

15. Apparatus as in claim 13 wherein each of the first and third beds has an area which does not exceed half that of the second bed.

16. Apparatus as in claim 13 wherein each of the first and third beds has an area appreciably less than half that of the second bed.

17. Apparatus as in claim 13 wherein the nozzles are directed generally normal to the copy sheet and toward one another.

18. Apparatus as in claim 13 wherein the nozzles are directly generally normal to the copy sheet and sufficiently toward one another that the inlet pressure of the second bed exceeds that of the first and third beds.

19. Apparatus as in claim 13 wherein the nozzles are directed generally normal to the copy sheet and sufficiently toward one another that the inlet pressure of the second bed is substantially atmospheric and the inlet pressures of the first and third beds are slightly subatmospheric.

20. Apparatus as in claim 13 wherein each of the first and second pipe means comprises a plurality of pipes spaced laterally of the direction of transport.

21. Apparatus as in claim 13 wherein each of the first and second pipe means comprises a streamlined pipe.

22. Apparatus for drying sheet bearing marking material and an oxidizable liquid including in combination means for transporting the sheet, a shell disposed adjacent the transporting means, the shell having mounted therein an oxidizing bed having an inlet and an outlet, the bed extending along the direction of transport, said inlet being disposed in proximity to the sheet, and a blower having an inlet communicating with the outlet of the bed and having an outlet communicating with the inlet of the bed.

23. Apparatus as in claim 22 wherein the shell has parallel sidewall portions and wherein the transporting means includes a belt disposed between said portions.

24. Apparatus as in claim 22 further including means for driving the blower and means for controlling the speed of the driving means.

25. Apparatus as in claim 22 further including means communicating with the outlet of the blower for exhausting gases from the shell.

26. Apparatus as in claim 22 further including manually controllable means communicating with the outlet of the blower for exhausting gases from the shell.

27. Apparatus as in claim 22 further including means comprising a nozzle communicating with the outlet of the blower for exhausting gases from the shell and means excited by the nozzle for reducing the temperature and velocity of exhaust gases.

28. Apparatus as in claim 22 further including automatically controlled means communicating with the outlet of the blower for exhausting gases from the shell.

29. Apparatus as in claim 22 further including means communicating with the outlet of the blower for exhausting gases from the shell, and means normally operable to block the exhaust means and selectively operable to unblock the exhaust means when a sheet is being dried.

30. Apparatus as in claim 22 further including a layer of heat insulating material covering a portion of the exterior of the shell.

31. Apparatus as in claim 22 further including a shroud mounted outside the shell and spaced therefrom and means for forcing cooling air into the space therebetween.

32. Apparatus as in claim 22 further including means for sensing the outlet temperature of the oxidizing bed.

33. Apparatus as in claim 22 wherein the transporting means includes a foraminous belt, further including a vacuum bed disposed adjacent the belt.

34. Apparatus as in claim 22 wherein the transporting means includes a foraminous belt, further including a vacuum bed disposed adjacent the belt, the vacuum bed being provided with a plurality of compartments disposed along the direction of transport, a vacuum manifold, and means providing restricted communication between each compartment and the manifold.

35. Apparatus as in claim 22 wherein the transporting means includes a foraminous belt, further including a vacuum bed disposed adjacent the belt, said vacuum bed including a foraminous plate.

36. Apparatus as in claim 22 further including means mounting the shell for pivotal movement about an axis extending laterally of the direction of transport.

37. Apparatus as in claim 22 wherein the construction of the oxidizing bed is such as to provide a relatively large pressure loss.

38. Apparatus as in claim 22 wherein the oxidizing bed comprises an inlet fabric layer and an outlet fabric layer.

39. Apparatus as in claim 22 wherein the oxidizing bed comprises an inlet fabric layer and an outlet fabric layer, each fabric layer being formed of glass fibers.

40. Apparatus for drying sheet bearing marking material and an oxidizable liquid including in combination means for transporting the sheet, a shell disposed adjacent the transporting means, the shell having mounted therein an oxidizing bed having an outlet, means for recirculating gases through the bed, and means for introducing an oxidizable hydrocarbon fluid into the shell.

41. Apparatus as in claim 40 wherein the fluid is a liquid and wherein the introducing means includes an injection pump.

42. Apparatus as in claim 40 further including means for sensing the outlet temperature of the bed and means responsive to the sensing means for controlling the introducing means.

43. Apparatus as in claim 40 further including means operable to drive the recirculating means and means rendering the drive means operative upon introduction of said fluid and when a sheet is being dried.

44. Apparatus as in claim 40 wherein the introducing means includes a container having a quantity of an oxidizable hydrocarbon fluid, said container being provided with a valve.

45. Apparatus as in claim 40 further including a container having a quantity of an oxidizable hydrocarbon liquid, means including a first conduit for continuously supplying said liquid from the container to the introducing means, and means including a second conduit for continuously returning a major portion of the supplied liquid from the introducing means to the container.

46. Apparatus as in claim 40 wherein the introducing means includes a container having a quantity of an oxidizable hydrocarbon liquid further including means for directing cooling air upon the container.

47. Apparatus for drying sheet bearing marking material and an oxidizable liquid in combination means for transporting the sheet, a shell disposed adjacent the transporting means, the shell having mounted therein an oxidizing bed, means for recirculating gases through the bed, the shell having a leading edge lip and a trailing edge lip, each lip extending laterally of the direction of transport and extending into proximity with the sheet but with a gap therebetween, said gaps providing passages for fresh air flow into the shell.

48. Apparatus as in claim 47 wherein the gaps are sufficiently small that the velocity of fresh air flow exceeds the transport speed of the sheet.

49. Apparatus as in claim 47 further including a shroud mounted outside the shell and spaced therefrom, means for forcing cooling air into the space therebetween, said cooling air being discharged adjacent said lips.

50. Apparatus as in claim 47 further including a shroud mounted outside the shell and spaced therefrom, means for forcing cooling air into the space therebetween, said cooling air being discharged adjacent said lips, and means for deflecting the discharged cooling air sufficiently away from the lips that the pressure immediately outside the lips is substantially atmospheric.

51. Apparatus as in claim 1 wherein the oxidizing means includes a catalyst.

52. Apparatus as in claim 2 wherein the oxidizing means comprises a bed of fine fibers.

53. Apparatus as in claim 2 wherein the oxidizing means comprises a bed of fine silica wool fibers.

54. Apparatus as in claim 13 wherein one oxidizing bed includes a catalyst.

55. Apparatus as in claim 13 wherein each oxidizing bed includes a catalyst.

56. Apparatus as in claim 22 wherein the oxidizing bed includes a catalyst.

57. Apparatus as in claim 40 wherein the oxidizing bed includes a catalyst.

58. Apparatus as in claim 47 wherein the oxidizing bed includes a catalyst.

59. Apparatus for heating a sheet including in combination an imaging surface bearing an image field, means including a liquid developer comprising field responsive toner particles dispersed in an oxidizable liquid carrier for developing said image, means for transferring from said surface to one side of the sheet the developed image and a generally uniform thin layer of carrier liquid, means for oxidizing said carrier liquid layer to produce hot gaseous oxidation products, and means utilizing said oxidation products to heat the sheet and vaporize a portion of the carrier liquid layer.

60. Sheet heating apparatus including in combination an imaging surface bearing an image field, means including field responsive toner particles for developing said image, means including means for transferring the developed image from said surface to a sheet for providing one side of the sheet with a pattern of field responsive toner particles and a generally uniform thin layer of an oxidizable liquid, means for oxidizing said liquid layer to produce hot gaseous oxidation products, and means utilizing said oxidation products to heat the sheet and vaporize a portion of the liquid layer.

61. Sheet heating apparatus including in combination means for transferring an image developed on an image field bearing surface from said surface to a sheet, means including the transferring means for providing one side of the sheet with a pattern of field responsive toner particles and a generally uniform thin layer of an oxidizable liquid, a shell disposed on said side of the sheet, means including means bearing against the other side of the sheet for transporting the same, an oxidizing bed disposed within the shell and having an inlet and an outlet, a blower having an inlet and an outlet, first means connecting the outlet of the blower to the inlet of the bed, and second means connecting the outlet of the bed to the inlet of the blower, one of the first and second means including said one side of the sheet.

62. Sheet heating apparatus including in combination means for transferring an image developed on an image field bearing surface from said surface to a sheet, means including the transferring means for providing one side of the sheet with a pattern of field responsive toner particles and a generally uniform thin layer of an oxidizable liquid, a chamber containing gases, an oxidizing bed disposed within the chamber, said bed having a certain minimum activation temperature, means for recirculating gases in the chamber through the bed, an electrical heater disposed within the chamber, means for energizing the heater until the recirculating gases are brought to a first temperature exceeding said minimum activation temperature, means for thereupon disabling the energizing means, and means thereupon operable to transport the sheet through the chamber.

63. Apparatus as in claim 62 wherein a portion of the liquid layer is vaporized and oxidized within the chamber to evolve heat, further including means providing the chamber with a fresh air inlet and means for exhausting gases from the chamber at a rate sufficiently low that the temperature of recirculating gases exceeds said first temperature.

64. Apparatus for heating a substrate bearing on its surface a first predetermined quantity of a material to be affixed thereto, and a second adjustable quantity of an oxidizable liquid including in combination a chamber containing gases, an oxidizing bed disposed within the chamber, said oxidizing bed having a certain minimum activation temperature, said substrate having a certain maximum permissible temperature, means for recirculating gases in the chamber through the bed, means for transporting the substrate through the chamber, and means operable independently of the first quantity of material for adjusting the second quantity of oxidizable liquid such that the temperature of recirculating gases lies in the range between said minimum and maximum temperatures.

65. A method of heating a substrate bearing on its surface a first predetermined quantity of a material to be affixed thereto and a second adjustable quantity of an oxidizable liquid including the steps of recirculating gases through an oxidizing bed disposed within a chamber, said oxidizing bed having a certain minimum activation temperature, said substrate having a certain maximum permissible temperature, transporting the substrate through the chamber, and adjusting the second quantity of oxidizable liquid independently of the first quantity of material such that the temperature of recirculating gases lies in the range between said minimum and maximum temperatures.

66. Apparatus for heating a substrate bearing an oxidizable liquid including in combination a chamber containing gases, an oxidizing bed disposed within the chamber, means for recirculating gases in the chamber through the bed, means for transporting the substrate through the chamber, said substrate having a certain maximum permissible temperature, means for admitting fresh air to the chamber and for exhausting hot gases from the chamber at such rate that the recirculating gases contain a predetermined quantity of air in excess of that required for complete oxidation of the liquid, and means including heat exchange means for cooling the chamber sufficiently that the temperature of recirculating gases is less than said maximum temperature.

67. Apparatus for heating a substrate bearing an oxidizable liquid including in combination a chamber containing gases, an oxidizing bed disposed within the chamber, said oxidizing bed having a certain minimum activation temperature, means for recirculating gases in the chamber through the bed, electrical heating means disposed within the chamber, means for electrically energizing the heating means until the recirculating gases are brought to a first temperature exceeding said minimum activation temperature, and means thereupon operable to disable the energizing means and to transport the substrate through the chamber at a predetermined constant rate.

* * * * *

UNITED STATES PATENT AND TRADEMARK OFFICE

CERTIFICATE OF CORRECTION

PATENT NO. : 4,538,899

DATED : September 3, 1985

INVENTOR(S) : Benzion Landa and Oded Sagiv

It is certified that error appears in the above-identified patent and that said Letters Patent is hereby corrected as shown below:

Column 21, line 26 - delete "catalytically".

Column 22, line 7 - delete "copy".

line 49 - after "drying" insert -- a --.

Column 23, line 53 - after "drying" insert -- a --.

line 65 - after "the" (second occurrence) insert -- oxidizing --.

Column 24, line 20 - after "drying" insert -- a --.

line 21 - after "liquid" insert -- including --.

Signed and Sealed this

*Thirty-first* Day of *December 1985*

[SEAL]

*Attest:*

DONALD J. QUIGG

*Attesting Officer*

*Commissioner of Patents and Trademarks*